US008815052B2

(12) United States Patent
Öhman et al.

(10) Patent No.: US 8,815,052 B2
(45) Date of Patent: Aug. 26, 2014

(54) METHOD FOR SEPARATING LIGNIN FROM A LIGNIN CONTAINING LIQUID/SLURRY

(75) Inventors: Fredrik Öhman, Gavle (SE); Hans Theliander, Göteborg (SE); Magnus Norgren, Matfors (SE); Per Tomani, Huddinge (SE); Peter Axegård, Solna (SE)

(73) Assignee: LignoBoost AB, Stockholm (SE)

( * ) Notice: Subject to any disclaimer, the term of this patent is extended or adjusted under 35 U.S.C. 154(b) by 898 days.

(21) Appl. No.: 11/661,412

(22) PCT Filed: Oct. 3, 2005

(86) PCT No.: PCT/SE2005/001453

§ 371 (c)(1),
(2), (4) Date: Sep. 8, 2007

(87) PCT Pub. No.: WO2006/038863

PCT Pub. Date: Apr. 13, 2006

(65) Prior Publication Data

US 2008/0051566 A1 Feb. 28, 2008

(30) Foreign Application Priority Data

Oct. 7, 2004 (SE) ..... 0402437

(51) Int. Cl.

| | |
|---|---|
| ***C07G 1/00*** | (2011.01) |
| ***C08H 7/00*** | (2011.01) |
| ***C08L 97/00*** | (2006.01) |
| ***D21C 1/00*** | (2006.01) |

(52) U.S. Cl.
USPC ..... 162/16; 530/500

(58) Field of Classification Search
USPC ..... 162/16; 530/500
See application file for complete search history.

(56) References Cited

U.S. PATENT DOCUMENTS

| | | | | | |
|---|---|---|---|---|---|
| 2,464,828 | A | * | 3/1949 | Pollak et al. | 530/500 |
| 2,470,764 | A | * | 5/1949 | Dunbar | 162/14 |
| 2,541,058 | A | | 2/1951 | Clark et al. | |
| 2,541,059 | A | * | 2/1951 | Heritage et al. | 530/500 |
| 2,541,127 | A | * | 2/1951 | Van Beckum | 530/500 |
| 2,623,040 | A | * | 12/1952 | Keilen, Jr. et al. | 530/500 |
| 2,680,113 | A | * | 6/1954 | Adler et al. | 530/500 |
| 2,697,701 | A | * | 12/1954 | Heritage et al. | 162/16 |
| 2,701,255 | A | * | 2/1955 | Heritage et al. | 556/108 |
| 2,727,028 | A | * | 12/1955 | Byrd et al. | 530/500 |
| 2,772,965 | A | * | 12/1956 | Gray et al. | 162/14 |
| 2,828,297 | A | * | 3/1958 | Giesen | 530/500 |
| 2,849,314 | A | * | 8/1958 | Goss | 162/163 |
| 2,913,310 | A | * | 11/1959 | Sandborn et al. | 423/189 |
| 2,976,273 | A | * | 3/1961 | Ball et al. | 530/506 |
| 2,994,633 | A | * | 8/1961 | Clark | 162/16 |
| 2,997,466 | A | * | 8/1961 | Ball et al. | 530/500 |
| 3,038,834 | A | * | 6/1962 | Thomsen | 162/16 |
| 3,048,576 | A | * | 8/1962 | Ball et al. | 530/500 |
| 3,095,409 | A | * | 6/1963 | King et al. | 530/506 |
| 3,130,115 | A | * | 4/1964 | Thomsen | 162/16 |
| 3,317,292 | A | * | 5/1967 | Juda | 48/209 |
| 3,404,063 | A | * | 10/1968 | Harding | 162/16 |
| 3,428,520 | A | * | 2/1969 | Yiannos | 162/38 |
| 3,806,403 | A | * | 4/1974 | Ferguson | 162/16 |
| 3,895,996 | A | | 7/1975 | Lange et al. | |
| 4,007,004 | A | * | 2/1977 | Bailey et al. | 8/636 |
| 4,470,876 | A | * | 9/1984 | Beaupre et al. | 162/16 |
| 4,891,070 | A | * | 1/1990 | Dilling et al. | 106/31.75 |
| 4,946,946 | A | * | 8/1990 | Fields et al. | 530/500 |
| 5,034,094 | A | * | 7/1991 | Kurple | 162/16 |
| 5,061,343 | A | * | 10/1991 | Azarniouch et al. | 162/16 |
| 5,096,540 | A | * | 3/1992 | Sell et al. | 162/16 |
| 5,288,857 | A | * | 2/1994 | Aarsrud et al. | 530/500 |
| 5,635,024 | A | * | 6/1997 | Shall | 162/16 |
| 5,707,490 | A | * | 1/1998 | Kuusio et al. | 162/16 |
| 5,777,086 | A | * | 7/1998 | Klyosov et al. | 530/500 |
| 5,811,527 | A | | 9/1998 | Ishitoku et al. | |
| 6,165,316 | A | * | 12/2000 | Iivonen et al. | 162/16 |
| 6,239,198 | B1 | * | 5/2001 | Abacherli et al. | 524/74 |
| 6,589,427 | B2 | * | 7/2003 | Moghe et al. | 210/667 |
| 6,632,327 | B1 | * | 10/2003 | Shall | 162/29 |
| 2002/0117455 | A1 | * | 8/2002 | Moghe et al. | 210/723 |
| 2002/0129910 | A1 | * | 9/2002 | Lightner | 162/16 |
| 2003/0221804 | A1 | * | 12/2003 | Lightner | 162/16 |
| 2004/0016525 | A1 | * | 1/2004 | Gervais | 162/16 |
| 2004/0244925 | A1 | * | 12/2004 | Tarasenko | 162/16 |
| 2008/0047674 | A1 | * | 2/2008 | Ohman et al. | 162/16 |
| 2008/0149568 | A1 | * | 6/2008 | Palonen et al. | 210/726 |
| 2008/0214796 | A1 | * | 9/2008 | Tomani et al. | 530/500 |

OTHER PUBLICATIONS

M.F. Davy et al., "Economic Evaluation of Black Liquor Treatment Processes for Increamental Kraft Pulp Production", 83rd Annual Meeting, Technical Section CPPA Jan. 28-31, 1997, p. 2, col. 1.

* cited by examiner

*Primary Examiner* — Liam J Heincer
(74) *Attorney, Agent, or Firm* — Young & Thompson

(57) ABSTRACT

A method for precipitating (separation) of lignin, using small amounts of acidifying agents, whereby a lignin product or an intermediate lignin product is obtained which can be used as fuel or chemical feed stock (or as a chemical or a raw material for further refining), from a lignin containing liquid/slurry, such as black liquor. A method for separation of lignin from a lignin containing liquid/slurry, such as black liquor, whereby a more pure lignin is obtained, a lignin product or an intermediate lignin product obtainable by the above methods, and use, preferably for the production of heat or for use as chemical, of the lignin product or intermediate lignin product are also disclosed.

19 Claims, 1 Drawing Sheet

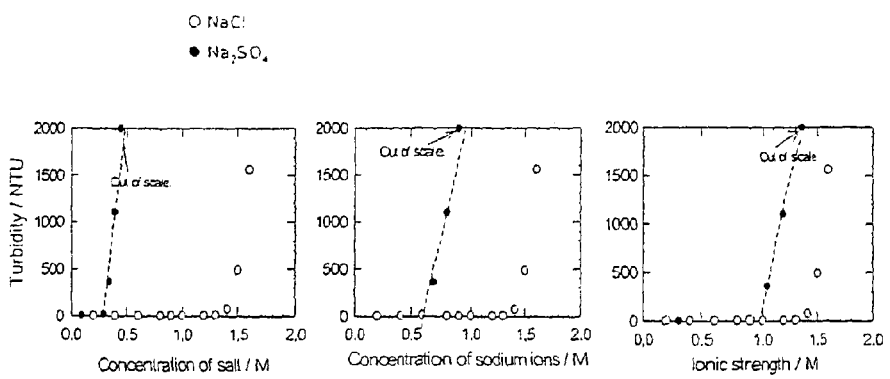
O NaCl
● $Na_2SO_4$
Turbidity / NTU
2000
1500
1000
500
0
Out of scale
0.0
0.5
1.0
1.5
2.0
Concentration of salt / M
Concentration of sodium ions / M
Ionic strength / M

METHOD FOR SEPARATING LIGNIN FROM A LIGNIN CONTAINING LIQUID/SLURRY

This invention concerns the technical field of lignin separation. In particular the present invention relates to a method for lignin separation from a lignin containing liquid/slurry, such as process liquors in a mill containing lignin, preferably black liquor.

Further the invention relates to lignin products obtainable by the above mentioned method and use of said products.

BACKGROUND

In a modern, energy-optimized pulp mill, there is a surplus of energy. With today's process, bark can be exported while the remaining energy surplus, in the form of mixtures comprising other burnable residues, is burned in the recovery boiler, with a relatively low efficiency with regard to electricity production. There is also often a problem that the heat transfer capacity in the recovery boiler is a narrow sector, which limits the production of pulp in the mill. The recovery boiler is the most expensive (instrument) unit in the pulp mill.

Separation of lignin from black liquor is an interesting solution to these problems. In this way, the energy surplus can be withdrawn from the process in the form of a solid biofuel and can be exported to e.g. a power station, where the fuel can be used more efficiently than in the recovery boiler of the pulp mill. This lignin is also a valuable material for production of "green chemicals". Further, lignin extraction leaves a black liquor for combustion with a lower thermal value, which in turn leads to a lower load on the recovery boiler. This gives in a short term perspective possibilities for increased pulp production. In the long perspective lower instrument cost for the recovery boiler is expected.

There are several possible procedures for such a separation, and industrial applications have been known for a long time. Already in 1944, Tomlinson and Tomlinson Jr were granted a patent (U.S. Pat. No. 664,811) for improvements to such a method. The separation method used today is to acidify the black liquor so that the lignin is precipitated in the form of a salt. The solid phase is separated from the liquor and can thereafter be cleaned or modified. There are industrial applications in operation today where lignin is separated from black liquor for use as special chemicals. One example of such a process is the precipitation of lignin from black liquor by acidification with carbon dioxide. The suspension is taken to a storage vessel for conditioning of the precipitate after which the solid lignin is separated and washed (with acidic wash water) on a band filter, and is finally processed to the desired state.

However, the present methods make use of high amounts of acidifying chemicals for separating lignin, which in turn may be used for fuel. Such procedures are thus very expensive and it would accordingly be of great benefit if it would be possible to reduce the amount of acidifying chemicals necessary for separating lignin. Accordingly, there is a need for a method where lignin can be separated using small amounts of acidifying chemicals, e.g. sulphuric acid or carbon dioxide.

SUMMARY OF THE INVENTION

The present invention solves one or more of the above problems by providing according to a first aspect a method for precipitating (separation) of lignin, using small amounts of acidifying agents, whereby lignin is obtained which can be used as fuel (or as a chemical feed stock; or as a chemical or a raw material for further refining), from a lignin containing liquid/slurry, such as black liquor, comprising the following steps:

a) addition of one or more compounds comprising sulphate or sulphate ions, or a mixture comprising said compound, to said liquid/slurry,
b) adjustment of the pH level of said liquid/slurry by acidifying, and
c) dewatering of said liquid/slurry whereby a lignin product or an intermediate lignin product is obtained.

In this above way lignin is separated more efficiently from e.g. black liquor and the filterability increases in the liquid where the precipitated lignin earlier was present.

The present invention also provides according to a second aspect a method for separation of lignin from a lignin containing liquid/slurry, such as black liquor, comprising the following steps:

i) precipitating of lignin by the adding of one or more compounds comprising sulphate or sulphate ions, or a mixture comprising said compound, to said liquid/slurry, and by acidifying said liquid/slurry, and thereupon dewatering,
ii) suspending the lignin filter cake whereupon a second suspension is obtained and adjusting the pH level to approximately the pH level of the washing water,
iii) dewatering of the second suspension,
iv) addition of washing water and performing a displacement washing at more or less constant conditions without any dramatic gradients in the pH, and
v) dewatering of the filter cake produced in step iv) into a high dryness and displacement of the remaining washing liquid in said filter cake, whereby a lignin product or an intermediate lignin product is obtained.

By using said method of the second aspect a more pure lignin is obtained. The present invention also provides according to a third aspect a lignin product or an intermediate lignin product obtainable by the method according to the first aspect. The present invention also provides according to a fourth aspect a lignin product or an intermediate lignin product obtainable by the method according to the second aspect. The present invention also provides according to a fifth aspect use, preferably for the production of heat or as chemical feed stock, of the lignin product or the intermediate lignin product of the third or fourth aspects.

The present invention is based upon that it has been found that sulphate ions precipitate/coagulate lignin unexpectedly efficiently compared with e.g. chloride. The previously available knowledge according to the so-called Hofmeister series—lyotropic series—(F. Hofmeister 1888) says that chloride precipitates proteins from albumen better than sulphate.

The anion series according to Hofmeister:

$$SCN^- > NO^{3-} > Cl^- > citrate > CH_3COO^- > PO_4^{3-} > SO_4^{2-}$$

From above it is evident according to Hofmeister that chloride precipitates proteins from albumen better than sulphate.

The cation series according to Hofmeister:

$$Ca^{2+} > Mg^{2+} > Na^+ = K^+ > NH_4^+ > N(CH_3)_4^+$$

DETAILED DESCRIPTION OF THE INVENTION

It is intended throughout the present description that the expression "lignin containing liquid/slurry" is any liquid or slurry, which contains lignin. This liquid or slurry may be a process liquor, containing lignin, in a mill, preferably said liquid or slurry is a black liquor.

It is intended throughout the present description that the expression "compound comprising sulphate or a sulphate ion" embraces any compound comprising sulphate or a sulphate ion. This compound may be Na—, K—, (Al—), Ca—, Mg—, Fe— or organic sulfate, $CaSO_4$, $K_2SO_4$, $Al_2SO_4$, iron sulfates or $MgSO_4$. Said compound may also be comprised in recovery boiler ashes, which is a mixture, or it may be essentially pure $Na_2SO_4$.

It is intended throughout the present description that the expression "acidifying" embraces any means for acidifying the lignin containing liquid/slurry, such as black liquor. Preferably the acidifying is performed by adding $SO_2$(g), organic acids, HCl, $HNO_3$, carbon dioxide or sulphuric acid (in the form of fresh sulfuric acid or a so called "spent acid" from a chlorine dioxide generator) or mixtures thereof to said liquid/slurry (preferably black liquor) most preferred by adding carbon dioxide or sulphuric acid.

It is intended throughout the present description that the expression "dewatering" embraces any means for dewatering. Preferably the dewatering is performed by using centrifugation, a filter press apparatus, a band filter, a rotary filter, such as a drum filter, or a sedimentation tank, or similar equipment, most preferred a filter press apparatus is used.

According to a preferred embodiment of the first aspect of the invention the dewatering of step c) is performed in a filter press apparatus.

According to a preferred embodiment of the first aspect of the invention the addition of step a) is done by adding recovery boiler ashes, i.e. ashes emanating from a soda recovery unit, which is a steam generator combined with a smelting furnace for the utilization of the heat of combustion of the black liquor and the recovery of the greater part of its inorganic components, or $Na_2SO_4$, $CaSO_4$, $K_2SO_4$, $Al_2SO_4$, iron sulfates or $MgSO_4$. Preferably $Na_2SO_4$ is used.

According to a preferred embodiment of the first aspect of the invention mixing is performed after the adjustment of the pH level in step b).

According to a preferred embodiment of the first aspect of the invention the pH level is adjusted to below approximately pH 9.5 in step b), preferably below approximately pH 6, most preferred the pH level is a pH from 1 to 4.

According to a preferred embodiment of the first aspect of the invention the pH level is adjusted whereby using $CO_2$.

According to a preferred embodiment of the first aspect of the invention the temperature is varied from 20 to 100° C. depending on the nature of the liquid/slurry containing lignin, such as black liquor.

According to a preferred embodiment of the first aspect of the invention the filtrate from step c) is re-circulated directly to a recovery system, preferably after re-alkalization.

According to a preferred embodiment of the second aspect of the invention the addition of step i) is done by adding recovery boiler ashes or $Na_2SO_4$, $CaSO_4$, $K_2SO_4$, $Al_2SO_4$, iron sulfates and/or $MgSO_4$. Preferably $Na_2SO_4$ is used.

According to a preferred embodiment of the second aspect of the invention mixing is performed after the acidifying in step i).

According to a preferred embodiment of the second aspect of the invention the pH level is adjusted in step i) through acidifying whereby using $CO_2$.

According to a preferred embodiment of the second aspect of the invention the temperature in step i) is varied from 20 to 100° C. depending on the nature of the liquid/slurry containing lignin, such as black liquor.

According to a preferred embodiment of the second aspect of the invention the dewatering of step i) and/or step iii) is performed in a filter press apparatus where the filter cake may be blown through by gas or a mixture of gases, preferably flue gases, air or vapor, most preferred air or overheated vapor, in order to dispose of the remaining lignin containing liquid/slurry such as black liquor (which is preferred).

According to a preferred embodiment of the second aspect of the invention the pH level is adjusted to below approximately pH 9.5 in step i), preferably below approximately pH 6, most preferred the pH level is a pH from 1 to 3.5.

According to a preferred embodiment of the second aspect of the invention the washing water has a pH level of below approximately pH 9.5, preferably below approximately pH 6, most preferred the pH level is a pH from 1 to 3.5.

According to a preferred embodiment of the second aspect of the invention the filter cake obtained in step i) is blown through by using gas or a mixture of gases, including e.g. flue gases, air and vapor (which preferably can be air or overheated vapor) before suspending said cake as set out in step ii).

According to a preferred embodiment of the second aspect of the invention the pH level adjustment is combined with an adjustment of the ion strength, preferably by using multivalent alkaline earth metal ions, most preferred calcium ions. In this preferred embodiment the lignin is stabilized during the washing, as set out above earlier in the preferred embodiment of the second aspect of the present invention, whereby a pH-decrease is combined with an adjustment of the ionic strength in the slurry stage, preferably with multivalent alkaline earth metal ions (e.g. calcium ions). At a given pH, a higher ionic strength in the suspension stage reduces the lignin yield losses. Here also the ionic strength and pH of the wash water essentially corresponds to the conditions in the slurry stage to avoid gradients during the washing process. A higher ionic strength in the slurry and in the wash water gives a stable lignin even at high pH-values. Besides making the washing easier, divalent calcium ions can be introduced into the lignin, which in the combustion of the lignin can bind sulfur in the form of calcium sulphate (Aarsrud et al 1990, WO 9006964).

According to a preferred embodiment of the second aspect of the invention the pH level adjustment combined with an adjustment of the ion strength corresponds to the pH level and ion strength of the washing liquid.

According to a preferred embodiment of the second aspect of the invention the filtrate from the first dewatering stage step i) is re-circulated directly to a recovery system, preferably after re-alkalization.

According to a preferred embodiment of the second aspect of the invention the remaining washing liquor in the filter cake in step v) is removed with air or flue gases, preferably flue gases from a recovery boiler, a lime kiln or a bark boiler.

According to a preferred embodiment of the second aspect of the invention the washing liquor and a part of the filtrate from the second dewatering in step iii) is returned to the re-slurrying stage step ii) to further reduce the consumption of acid and water.

Accordingly, one or more compounds comprising sulphate or a sulphate ion, or a mixture comprising said compound such as recovery boiler ashes, is added during step a) (or step i)) in the method according to the first aspect (or the method according to the second aspect) to increase the ionic strength in the lignin containing liquid/slurry, such as black liquor, and thus be able to precipitate with a lower acid consumption or alternatively achieve a greater lignin precipitation with the same amount of added acid. This is particularly interesting since the sulfate ion would, as indicated in the appended FIG. 1, itself have an effect on the precipitation in addition to the fact that it increases the ionic strength. From a systems engineering perspective, it is to be expected that the sulfidity of the mill (the Na/S-balance) is influenced in a way which would require attention. Burkeite precipitation in the black liquor evaporation would also be affected and the requirements for the handling of this material would increase. On the other hand, the results show that it would be possible to reduce both the investment costs (the filtration surface) and the operating costs (reduced $CO_2$-costs) for removing lignin from e.g. black liquor significantly.

Preferred features of each aspect of the invention are as for each of the other aspects mutatis mutandis. The prior art documents mentioned herein are incorporated to the fullest extent permitted by law. The invention is further described in the following examples in conjunction with the appended FIGURE, which do not limit the scope of the invention in any way. Embodiments of the present invention are described in more detail with the aid of examples of embodiments and FIGURE, the only purpose of which is to illustrate the invention and are in no way intended to limit its extent.

SHORT DESCRIPTION OF THE FIGURE

FIG. 1 shows results that suggest that sulfate is better at precipitating/coagulating lignin than expected according to the literature. Here, chloride and sulfate are compared.

EXAMPLES

Tests in laboratory, whereby studies of a separation of lignin have been performed, have shown positive results, in the form of both a yield increase and a better filterability. In the test, black liquor from Värö Mill was used (30% DS, Dry Substance). To two liters of this liquor, 100 g $Na_2SO_4$ was added—which should be a reasonable quantity if it is assumed that 30% of the black liquor flow is treated in the lignin precipitation stage and that all the recovery boiler ashes are added to this flow. The black liquor was acidified with $CO_2$ to a pH of ca. 9.6 at 80° C. After the acidification, the slurry was allowed to stand with continuous stirring for 30 minutes, after which it was filtered. A reference test without the addition of $Na_2SO_4$ was carried out in the same way.

For these two tests (with and without $Na_2SO_4$-addition), the yield in the precipitation stage was determined (according to previously known methods). With $Na_2SO_4$-addition, the yield increased by 6.3 percentage points (from 60.5 to 66.8% at the same precipitation-pH of ca. 9.6). The filterability, expressed as the specific filter resistance, was also improved dramatically from $1.6 \cdot 10^{10}$ for the reference test to $6.9 \cdot 10^{8}$ with the addition of $Na_2SO_4$.

Various embodiments of the present invention have been described above but a person skilled in the art realizes further minor alterations, which would fall into the scope of the present invention. The breadth and scope of the present invention should not be limited by any of the above-described exemplary embodiments, but should be defined only in accordance with the following claims and their equivalents. For example, any of the above-noted methods can be combined with other known methods e.g. for separating lignin from a lignin containing liquid/slurry, such as black liquor. Other aspects, advantages and modifications within the scope of the invention will be apparent to those skilled in the art to which the invention pertains.

The invention claimed is:

1. A method for separation of lignin from a lignin containing black liquor slurry, comprising the following steps:

i) precipitating lignin by adding one or more compounds comprising sulphate or sulphate ions, or a mixture comprising said compound, said compound being selected from the group consisting of recovery boiler ashes, $Na_2SO4$, $CaSO_4$, $K_2S0_4$, $Al_2SO_4$, iron sulfates or $MgSO_4$, to said black liquor slurry, and by lowering a pH of said liquid/slurry using $CO_2$, and thereupon dewatering to obtain a first lignin filter cake;

ii) suspending the first lignin filter cake whereupon a second suspension is obtained having a pH level below 6, iii) dewatering of the second suspension to obtain a second lignin filter cake;

iv) adding washing water to the second lignin filter cake and performing a displacement washing at more or less constant conditions at the pH level below 6; and v) dewatering of the second filter cake to dryness and displacement of remaining washing liquid in said second lignin filter cake, whereby a lignin product or an intermediate lignin product is obtained.

2. The method according to claim 1 wherein mixing is performed after the acidifying in step i).

3. The method according to claim 1 wherein a temperature in step i) is varied from 20 to 100° C.

4. The method according to claim 1 wherein the dewatering of step i) and/or step iii) is performed in a filter press apparatus where the first and/or second filter cake is blown through by gas, a mixture of gases, flue gases, air, vapor, or overheated vapor, in order to dispose of the remaining lignin containing black liquor slurry.

5. The method according to claim 1 wherein the pH level is from 1 to 3.5.

6. The method according to claim 1 wherein the washing water has a pH level from 1 to 3.5.

7. The method according to claim 1 wherein the first lignin filter cake obtained in step i) is blown through by using gas, a mixture of gases, flue gases, air, vapor, or overheated vapor, before suspending said first lignin filter cake.

8. The method according to claim 1 wherein the pH level adjustment is combined with an adjustment of the ion strength by using multivalent alkaline earth metal ions or calcium ions.

9. The method according to claim 8 wherein the pH level adjustment combined with an adjustment of the ion strength corresponds to the pH level and ion strength of the washing liquid.

10. The method according to claim 1 wherein a filtrate from the first dewatering stage step i) is re-circulated directly to a recovery system after re-alkalization.

11. The method according to claim 1 wherein the remaining washing liquor in the second lignin filter cake in step v) is removed with air, flue gases, flue gases from a recovery boiler, flue gases from a lime kiln or flue gases from a bark boiler.

12. The method according to claim 1 wherein a washing liquor and a part of a filtrate from the second dewatering in step iii) is returned to the re-slurrying stage step ii) to further reduce a consumption of acid and water.

13. The method according to claim 1 wherein the pH in step i) is lowered to below approximately 9.5.

14. The method according to claim 1 wherein the pH in step i) is lowered to approximately 9.6 at 80° C.

15. The method according to claim 1 wherein the compound is $Na_2SO4$.

16. A method for separation of lignin from a lignin containing black liquor slurry, comprising the following steps:

i) precipitating lignin by adding one or more compounds comprising sulphate or sulphate ions, or a mixture comprising said compound, said compound being selected from the group consisting of recovery boiler ashes, $Na_2SO4$, $CaSO_4$, $K_2S0_4$, $Al_2SO_4$, iron sulfates or $MgSO_4$, to said black liquor slurry, and by lowering a pH of said liquid/slurry to below approximately 9.5 using $CO_2$, and thereupon dewatering to obtain a first lignin filter cake;

ii) suspending the first lignin filter cake whereupon a second suspension is obtained having a pH level below 6, iii) dewatering of the second suspension to obtain a second lignin filter cake;

iv) adding washing water to the second lignin filter cake and performing a displacement washing at more or less constant conditions at the pH level below 6; and v) dewatering of the second filter cake to dryness and displacement of remaining washing liquid in said second lignin filter cake, whereby a lignin product or an intermediate lignin product is obtained.

17. The method according to claim 16 wherein the compound is $Na_2SO4$.

18. A method for separation of lignin from a lignin containing black liquor slurry, comprising the following steps:

i) precipitating lignin by adding one or more compounds comprising sulphate or sulphate ions, or a mixture comprising said compound, said compound being selected from the group consisting of recovery boiler ashes, $Na_2SO4$, $CaSO_4$, $K_2S0_4$, $Al_2SO_4$, iron sulfates or $MgSO_4$, to said black liquor slurry, and by lowering a pH of said liquid/slurry to approximately 9.6 at 80° C. using $CO_2$, and thereupon dewatering to obtain a first lignin filter cake;

ii) suspending the first lignin filter cake whereupon a second suspension is obtained having a pH level below 6, iii) dewatering of the second suspension to obtain a second lignin filter cake;

iv) adding washing water to the second lignin filter cake and performing a displacement washing at more or less constant conditions at the pH level below 6; and v) dewatering of the second filter cake to dryness and displacement of remaining washing liquid in said second lignin filter cake, whereby a lignin product or an intermediate lignin product is obtained.

19. The method according to claim 18 wherein the compound is $Na_2SO4$.

* * * * *